US006341971B1

(12) United States Patent
Choy et al.

(10) Patent No.: US 6,341,971 B1
(45) Date of Patent: Jan. 29, 2002

(54) DUPLEX PROFILE CONNECTOR ASSEMBLY

(75) Inventors: Edmond Choy, Union City, CA (US); Chih-Nan Lin, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/652,960

(22) Filed: Aug. 31, 2000

Related U.S. Application Data

(63) Continuation-in-part of application No. 09/498,828, filed on Feb. 4, 2000.

(51) Int. Cl.[7] ..... H01R 13/62
(52) U.S. Cl. ..... 439/326
(58) Field of Search ..... 439/325–328, 439/64, 79, 541.5

(56) References Cited

U.S. PATENT DOCUMENTS 4,747,790 A * 5/1988 Masuda et al. ..... 439/326
5,030,115 A * 7/1991 Regnier et al. ..... 439/541.5
5,176,523 A * 1/1993 Lai ..... 439/541.5
5,415,573 A * 5/1995 Chen et al. ..... 439/326
5,641,295 A * 6/1997 Koyama ..... 439/326
5,697,802 A * 12/1997 Kawabe ..... 439/326
5,839,913 A * 11/1998 Fumikura ..... 439/326
5,993,234 A * 11/1999 Yodogawa ..... 439/326
6,077,098 A * 6/2000 Yu et al. ..... 439/326

* cited by examiner

*Primary Examiner*—Gary F. Paumen
(74) *Attorney, Agent, or Firm*—Wei Te Chung

(57) ABSTRACT

A double-deck connector assembly (1) includes a unitary housing (10) defining upper and lower connection ports (12, 14) with upper and lower central slots (16, 17) for respectively receiving the corresponding upper and lower modules (100, 200) therein. The upper connection port (12) is slightly forwardly offset from the lower connection port (14). A pair of latching arms (20, 22) extend from two opposite ends of each connection port (12, 14) for retaining the corresponding module (100, 200) in position. A latching lug (28, 34) is formed on each latching arm (20, 22) for locking the module (100, 200) in position. A guidance surface (85) is formed around a lower portion of the upper latch arm (20) so that the upwardly rotated lower module (200) can guidably move along the guidance surface (85) to outwardly push away the corresponding upper latch arm (20) thereabove to reach the initial insertion angular position which is essentially above the upper latch arm (20).

1 Claim, 11 Drawing Sheets

DUPLEX PROFILE CONNECTOR ASSEMBLY

This is a continuation-in-part of the copending application Ser. No. 09/498,828 filed Feb. 4, 2000.

BACKGROUND OF THE INVENTION

1. Field of the Invention

The invention relates to double deck connector assemblies, and particularly to an improvement to the connector assembly disclosed in copending application Ser. No. 09/619,864 filed on Jul. 20, 2000.

2. The Related Art

The copending application having the same inventorship and the same title filed on Jul. 20, 2000, generally discloses a double-deck SO DIMM (Small Outline Dual Inline Memory Module) connector assembly where two-step withdrawal of the lower module (daughter card) is achieved for more organizational arrangement. As mentioned in this copending application, each of most existing prior art double-deck connector assemblies is characterized with a relatively larger-dimensioned offset between the upper housing and the lower housing in the front-to-back direction, thus occupying more space on the printed circuit (mother) board on which the connector assembly is seated. Differently, the aforementioned copending application discloses a connector assembly with a relatively smaller-dimensioned offset between the upper and the lower housing in the front-to-back direction for saving the space on the printed circuit (mother) board.

Anyhow, some operators/technicians working on the assembling sometimes prefer to have a one-step withdrawal of the lower module rather than two-step one which is one of the features of the aforementioned copending application in which the lower module may be temporarily retained between the upper deck and the lower deck during rotative withdrawal.

Therefore, an object of the invention is to provide a double-deck connector assembly which owns the advantageous smaller offset as shown in the copending application while permitting one-step withdrawal of the lower module instead.

SUMMARY OF THE INVENTION

According to an aspect of the invention, a double-deck connector assembly includes a unitary housing defining upper and lower connection ports with upper and lower central slots for respectively receiving the corresponding upper and lower modules therein. The upper connection port is slightly forwardly offset from the lower connection port. A pair of latch arms extend from two opposite ends of each connection port for retaining the corresponding module in position. A latching lug is formed on each latch arm for locking the module in position wherein the latching lug of the lower latch arm includes a vertical section received within the notch of the lower module and a horizontal section, which is integrally connected to the vertical section, abutting against and positioned on the upper surface of the lower module around the periphery of the corresponding notch, while the latching lug of the upper latch arm includes a vertical section received within the corresponding notch of the upper module and a horizontal section, which is integrally connected to the vertical section, abutting against and positioned on the upper surface of the upper module around the side edge close to said notch. Therefore, the lower module is allowed to be inserted into the lower connection port with the initial angular insertion position which is substantially above the latching lug of the upper latch arm under the condition that the upper connection port is only slightly forwardly offset from the lower connection port. The dimension, position and contour of the latching lug of the upper latch arm are properly configured to correlate the (standard) notch of the lower module for allowing insertion/withdrawal of the lower module with regard to the connector housing via deflection of the upper latch arm.

Specifically, such withdrawal of the lower module is arranged to be done via one step instead of the so-called two steps disclosed in the aforementioned copending application, wherein a guidance face is provided around the upper latch arm for guidably allowing the lower module to continuously/successively upwardly move, after manually releasing the lower latch arm, by capably/automatically deflecting the corresponding upper latch arm away instead of being temporarily held between the upper latch arm and the lower latch arm, so as to meet the user's desire while still keeping the advantageous smaller offset of the first generation invention disclosed in the aforementioned copending application.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 8:
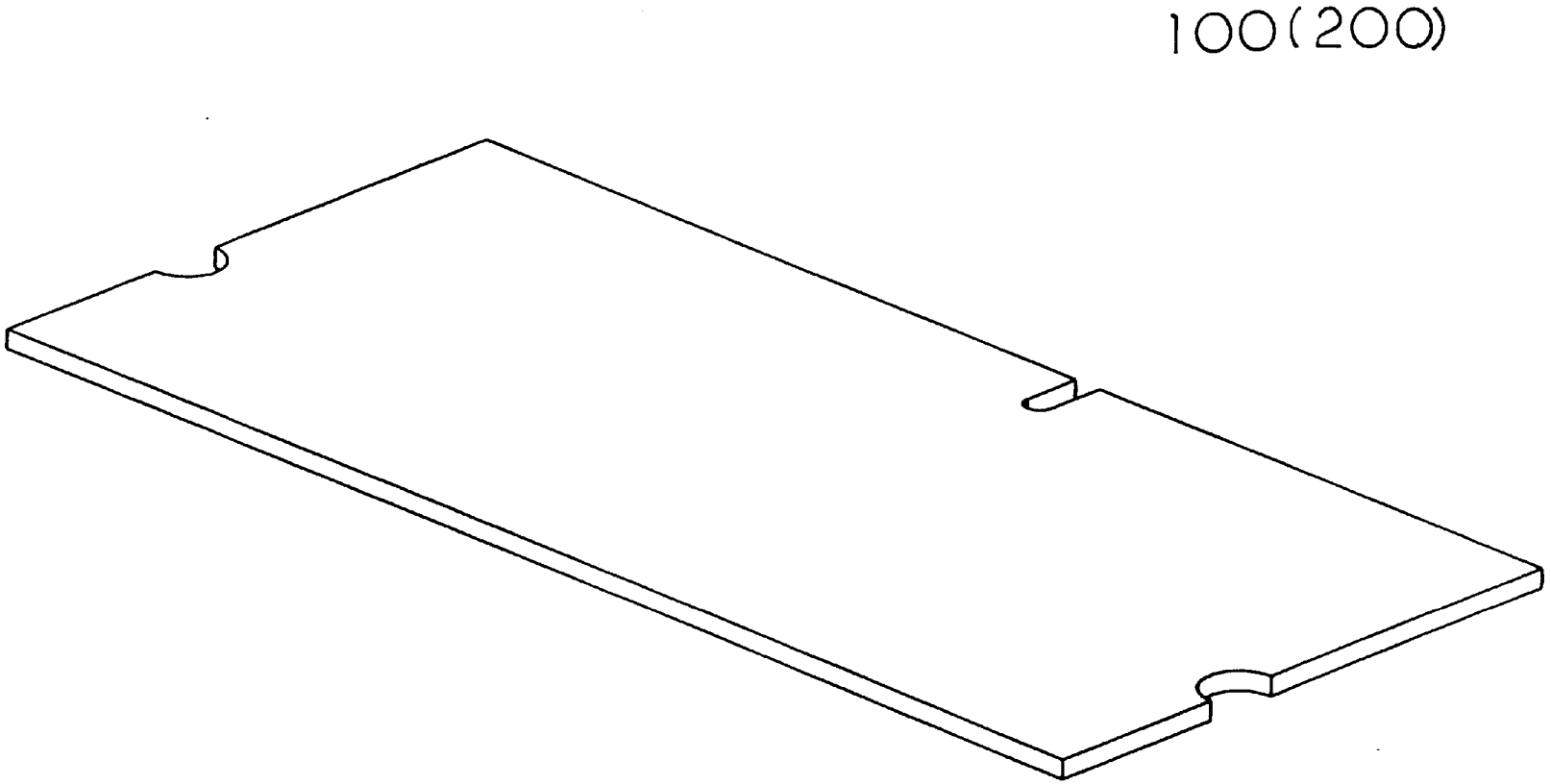
FIG. 8 is a perspective view of the printed circuit board for use with the connector assembly of FIG. 1.
Figure 9:
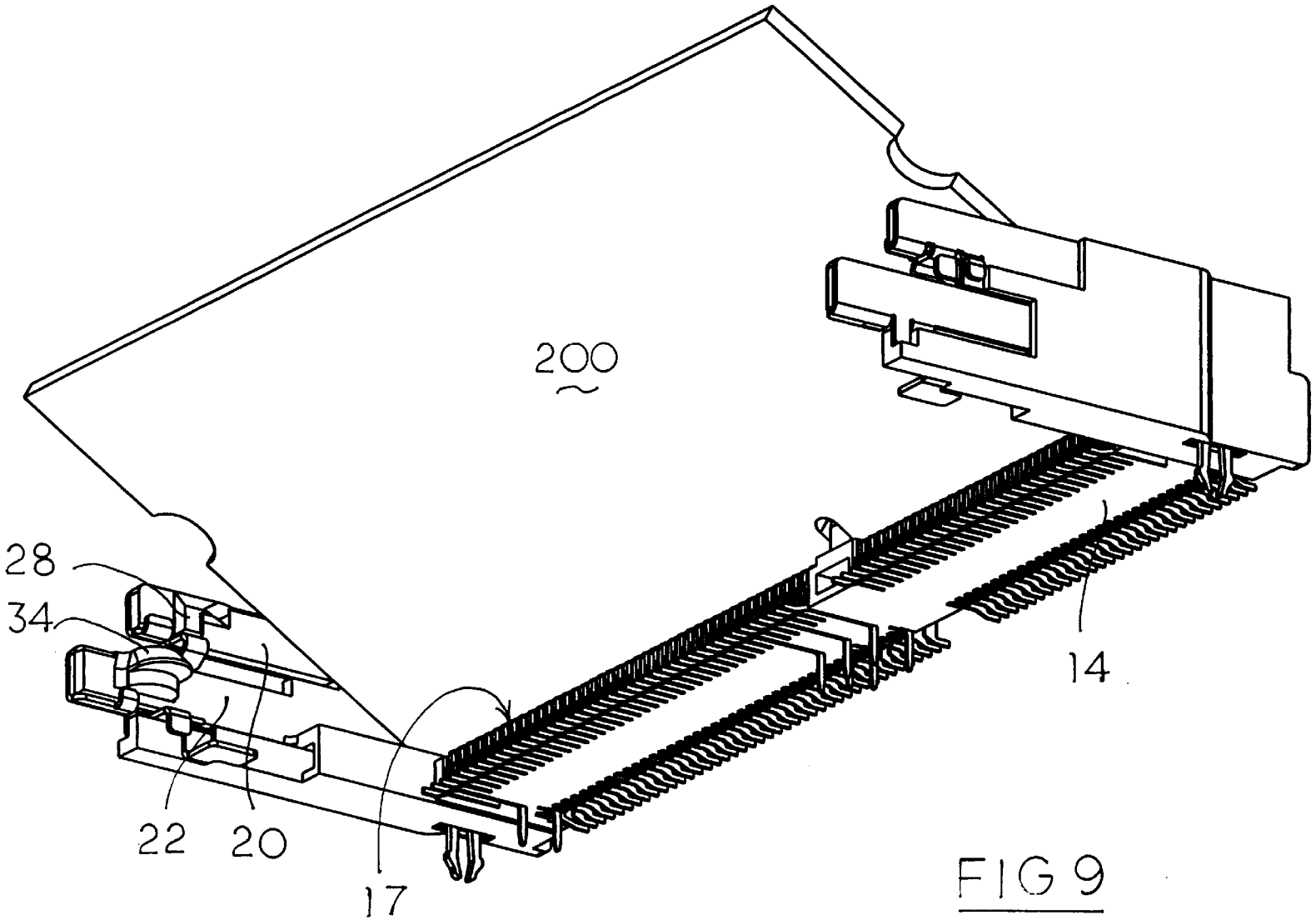
FIG. 9 is a perspective view of the connector assembly of FIG. 1 with a lower module at an insertion/withdrawal position.
Figure 10:
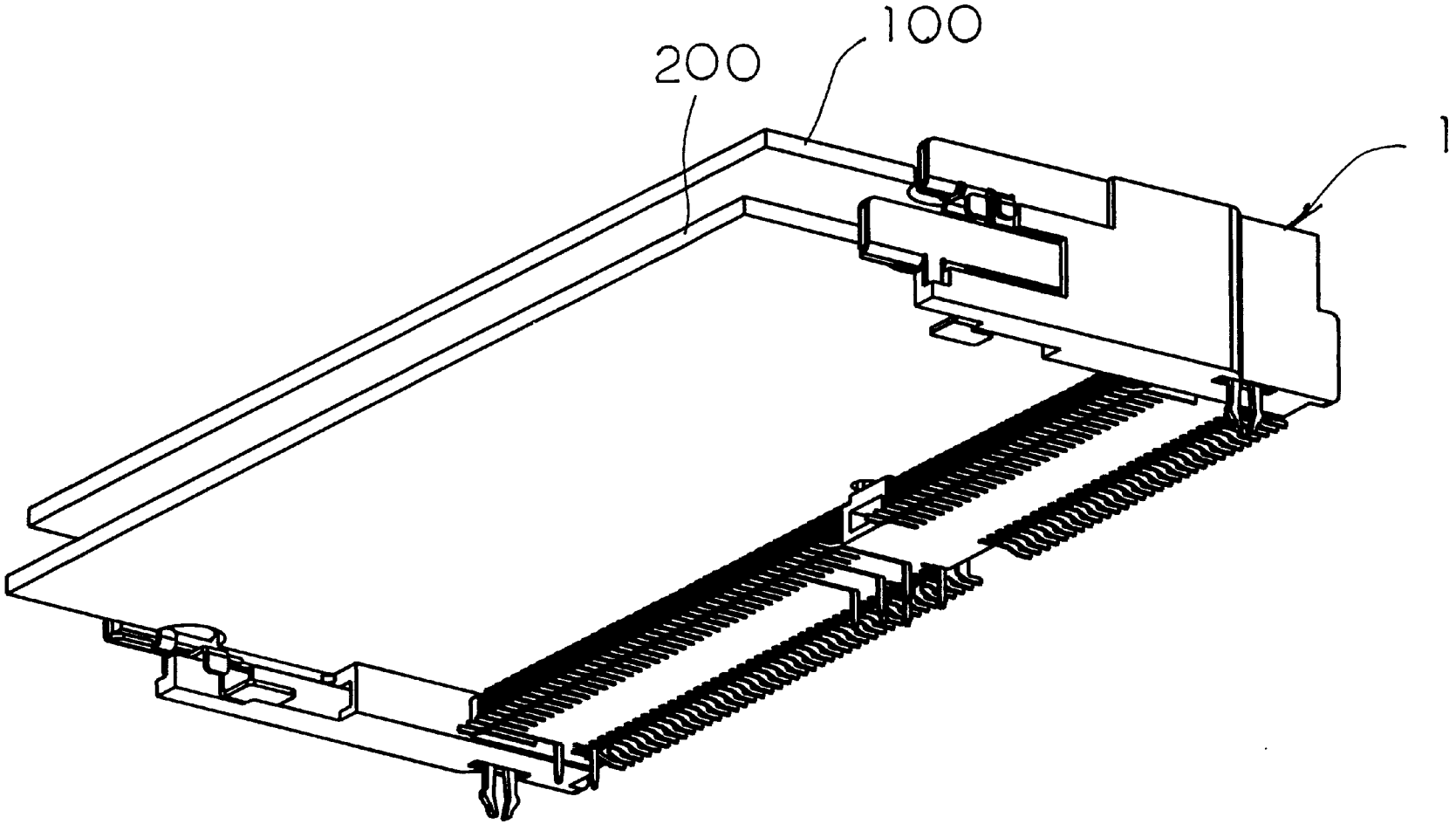
FIG. 10 is a perspective view of the connector assembly of FIG. 1 with therein both upper and lower modules in position.

It will be noted here that for a better understanding, most of like components are designated by like reference numerals throughout the various figures in the embodiments. Also, because the invention focuses on the one-step withdrawal of the lower module, only the structures relating to this feature are illustrated in detail while the other portions may be referred to the aforementioned copending application. Attention is directed to FIGS. 1–10 wherein a double-deck connector assembly 1 includes an insulative housing 10 defining an upper connection port 12 and a lower connection port 14 for respectively receiving upper and lower (level) modules 100, 200 therein (FIGS. 8–10). The upper(lower) connection port 12, 14 includes an upper(lower) central slot 16(17) with a plurality of contacts 18 aside. The upper connection port 12 is somewhat forwardly offset from the lower connection port 14 in a front-to-back direction of the connector assembly 1.

A pair of upper(lower) latch arms 20(22) are respectively integrally formed at two opposite ends of the upper(lower) connection portion 12(14). An optional auxiliary metal supporting arm 24(26) is disposed beside each latch arm 20(22) and directly fastened to the housing 10 for provision of auxiliary strength of the latch arm 20(22) during deflection of the latch arm 20(22).

A first or upper latching lug 28 is formed around the distal end of the upper latch arm 20 for latchably engaging the upper module 100 (FIGS. 8 and 10). A second or lower latching lug 34 is formed around the distal end of the lower latch arm 22 for latchably engaging the lower module 200. Because the offset arrangement between the upper connection port 12 and the lower connection port 14, the first latching lug 28 of the upper latch arm 20 is also forwardly offset from the second latching lug 34 of the lower latch arm 22.

Figure 1:
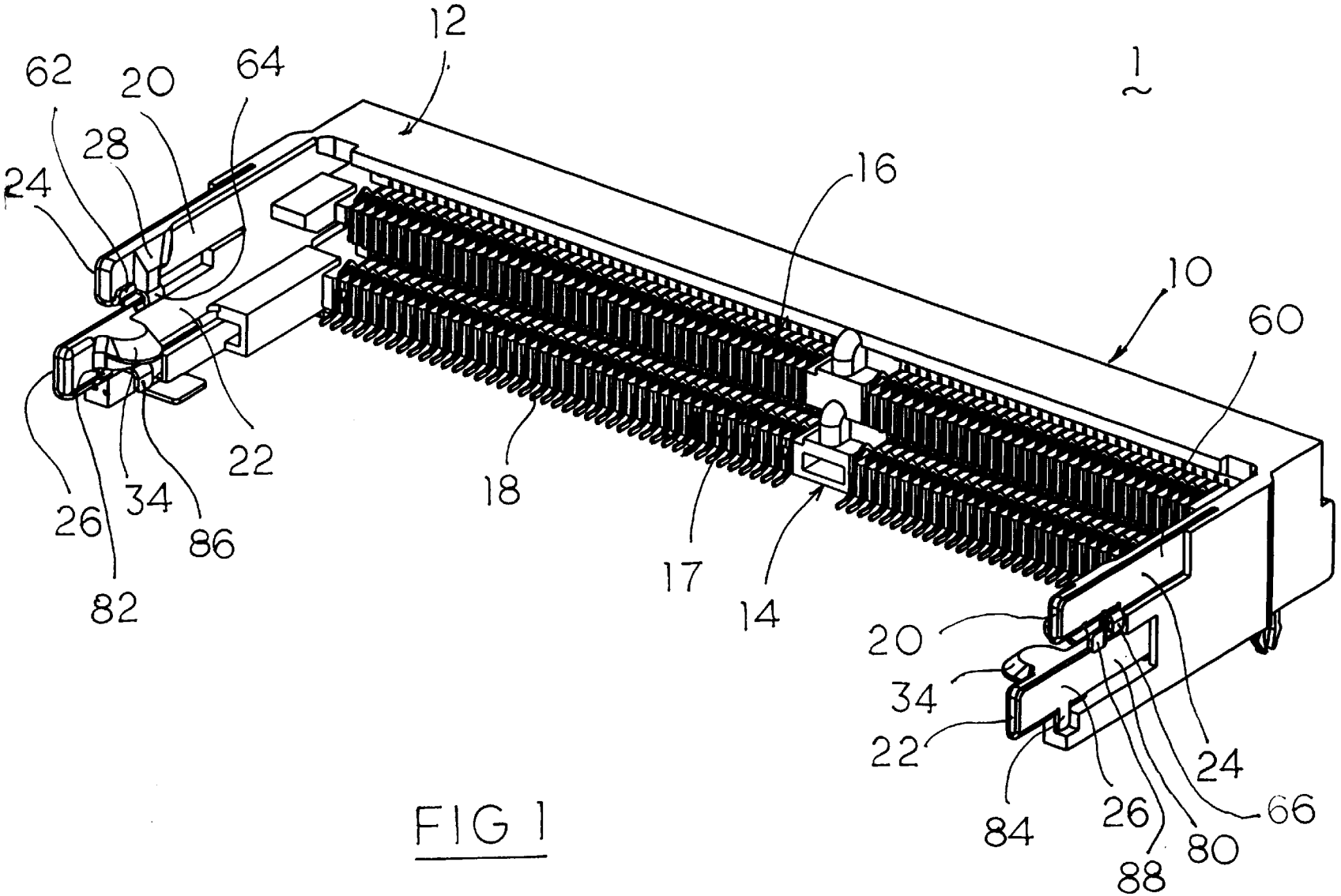
FIG. 1 is a perspective view of a double-deck connector assembly according to the invention.
Figure 2:
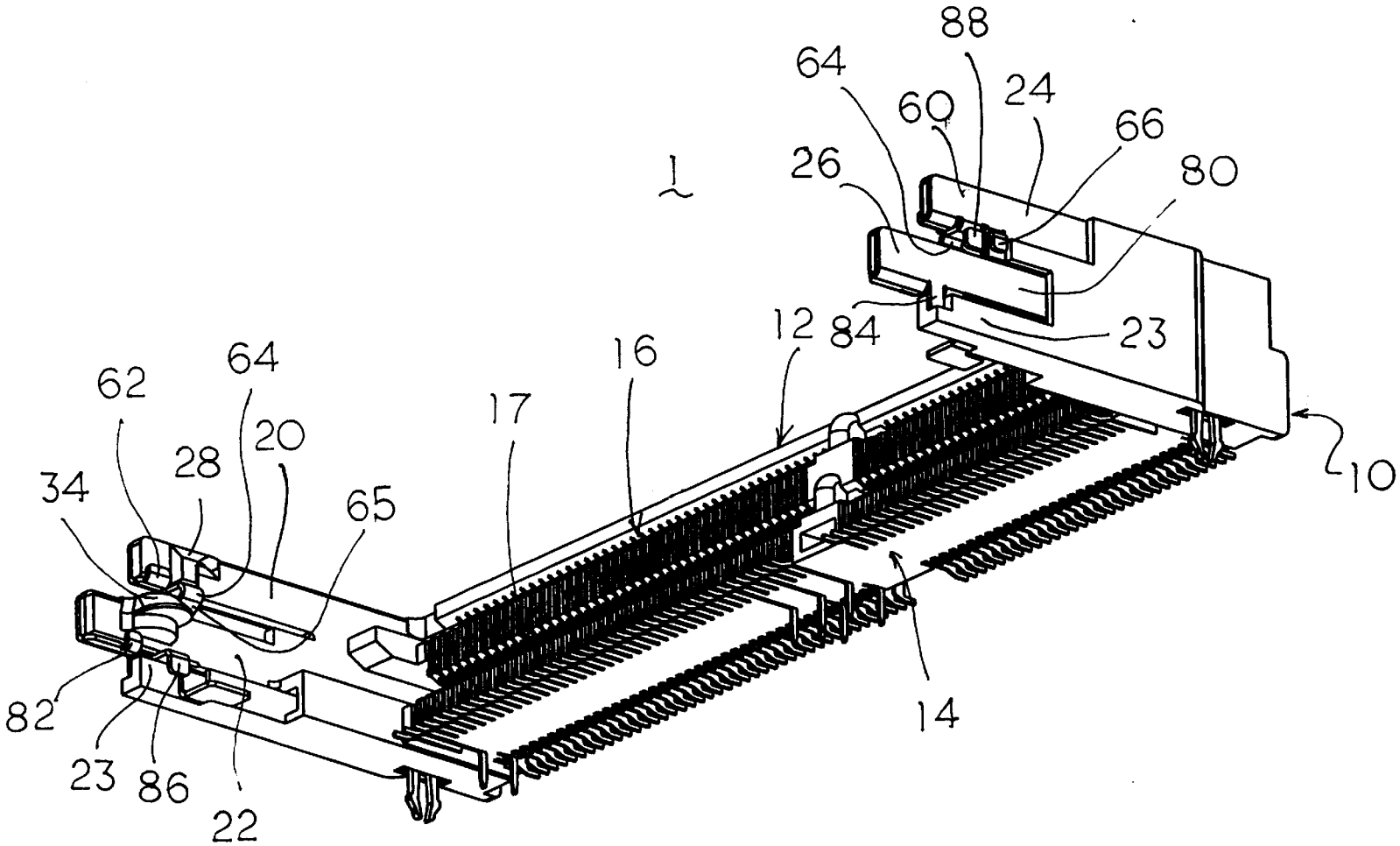
FIG. 2 is a perspective view of the connector assembly of FIG. 1 from another angle.
Figure 3:
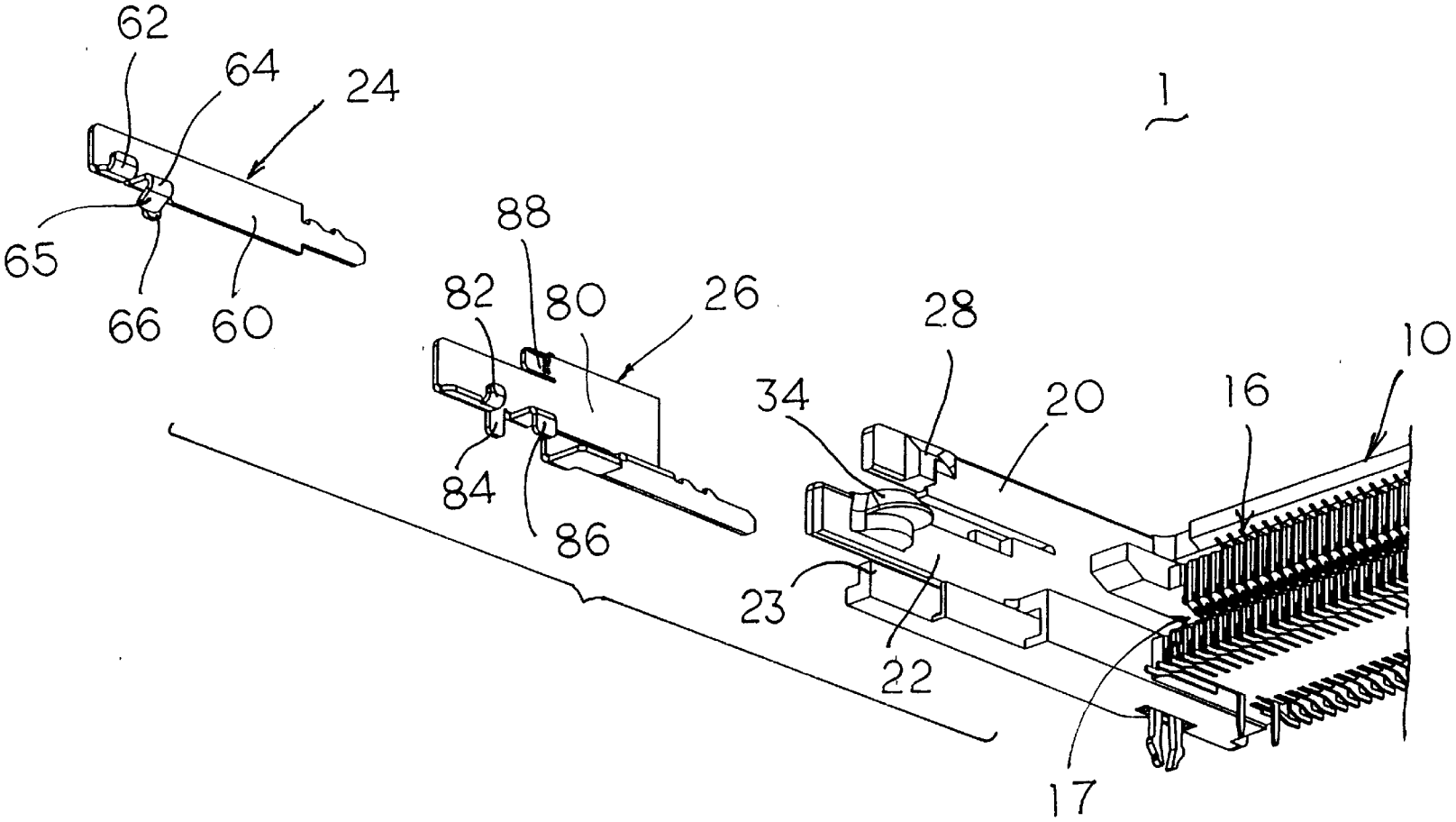
FIG. 3 is an enlarged partial perspective view of the connector assembly of FIG. 1 to show the latch arm and the associated support arm thereof.
Figure 4:
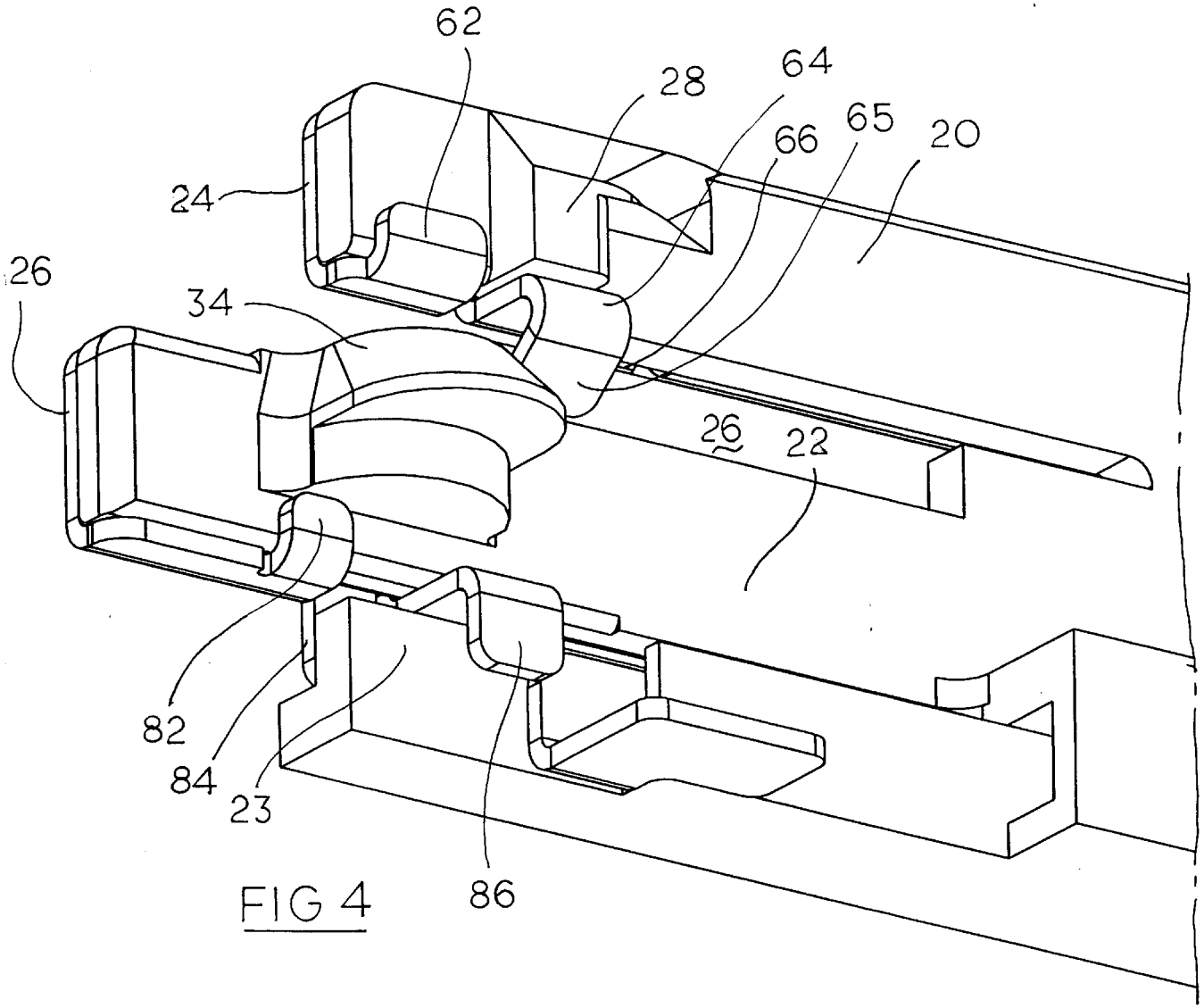
FIG. 4 is an enlarged exploded partial perspective view of the connector assembly of FIG. 1.
Figure 5:
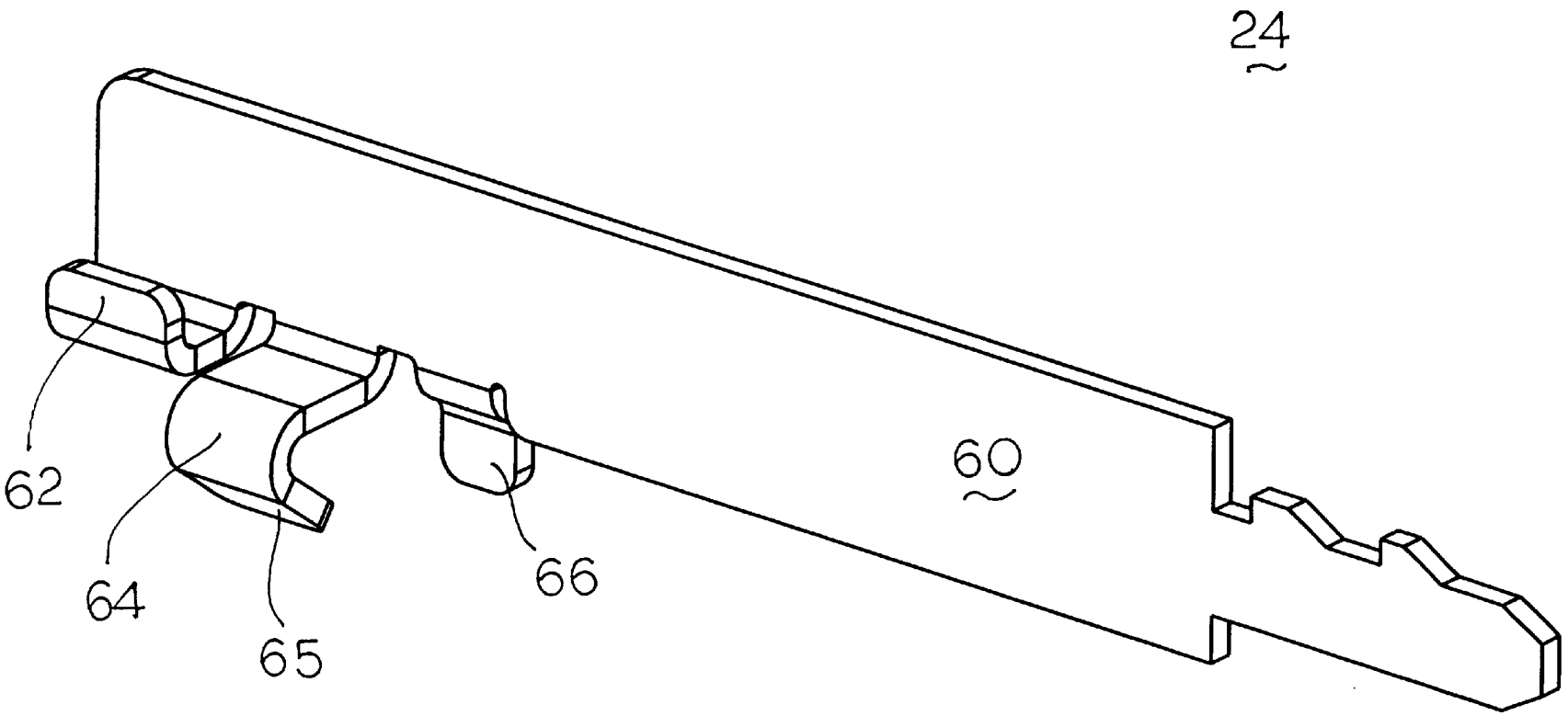
FIG. 5 is a perspective view of the upper support arm of the connector assembly of FIG. 1 from another angle.
Figure 5A:
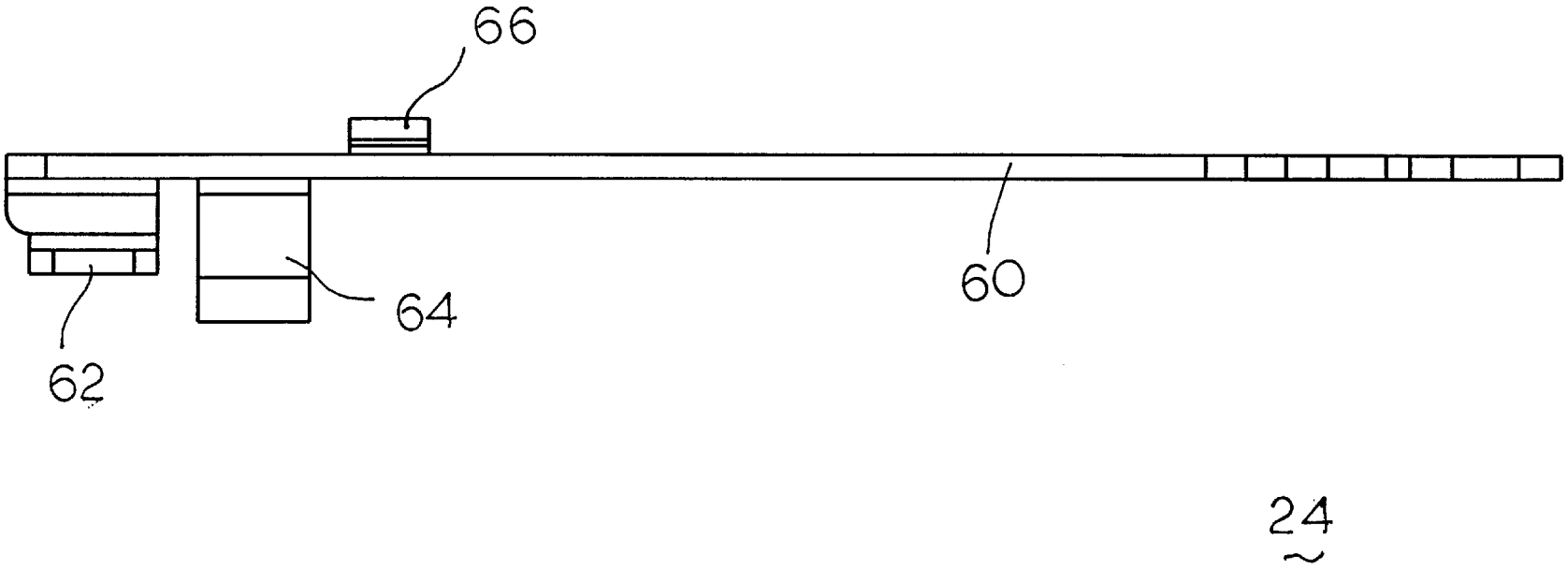
FIG. 5(A) is a plan view of the upper support arm of the connector assembly of FIG. 1.
Figure 6:
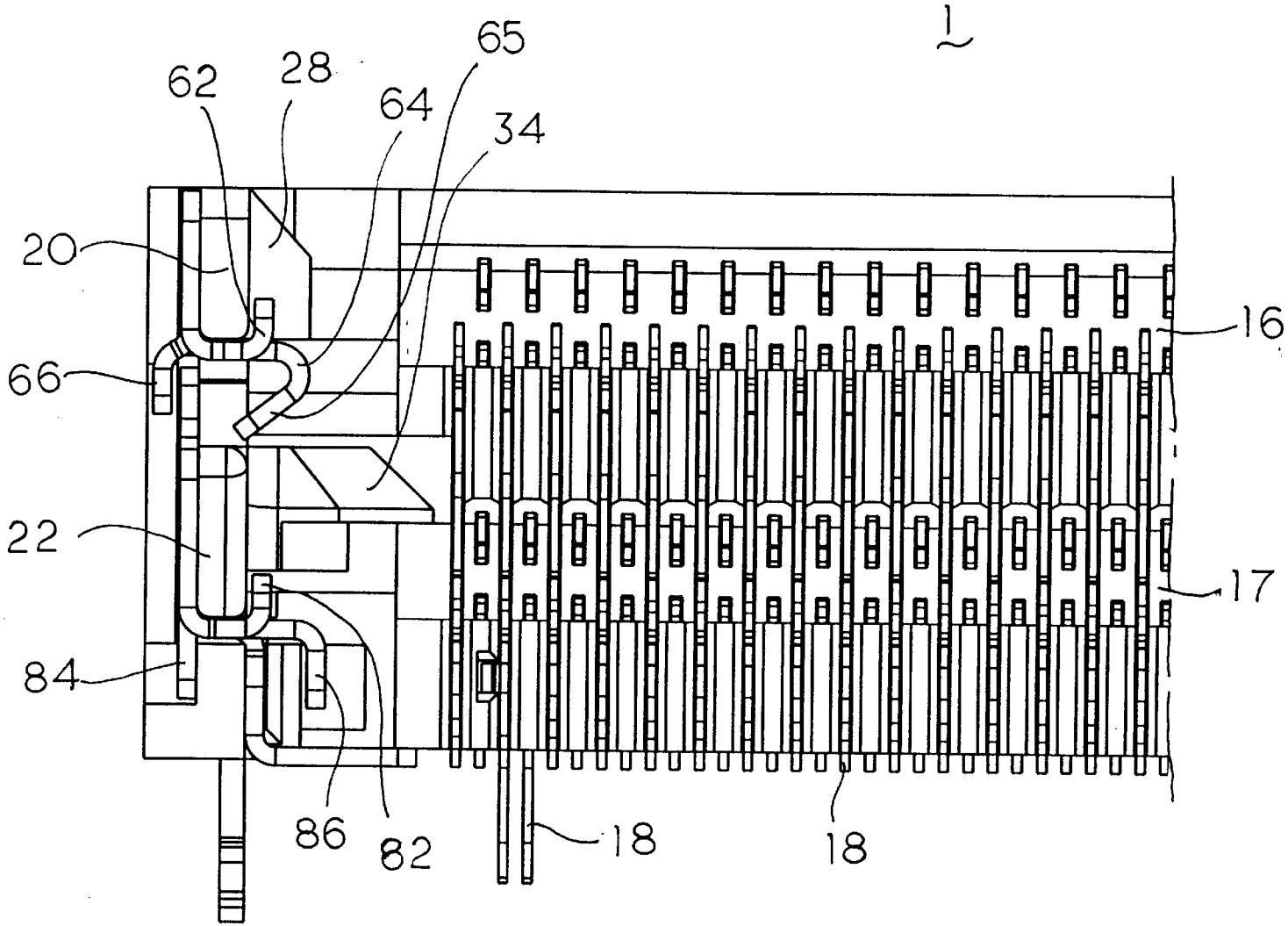
FIG. 6 is an enlarged partial plan view of the connector assembly of FIG. 1.
Figure 7:
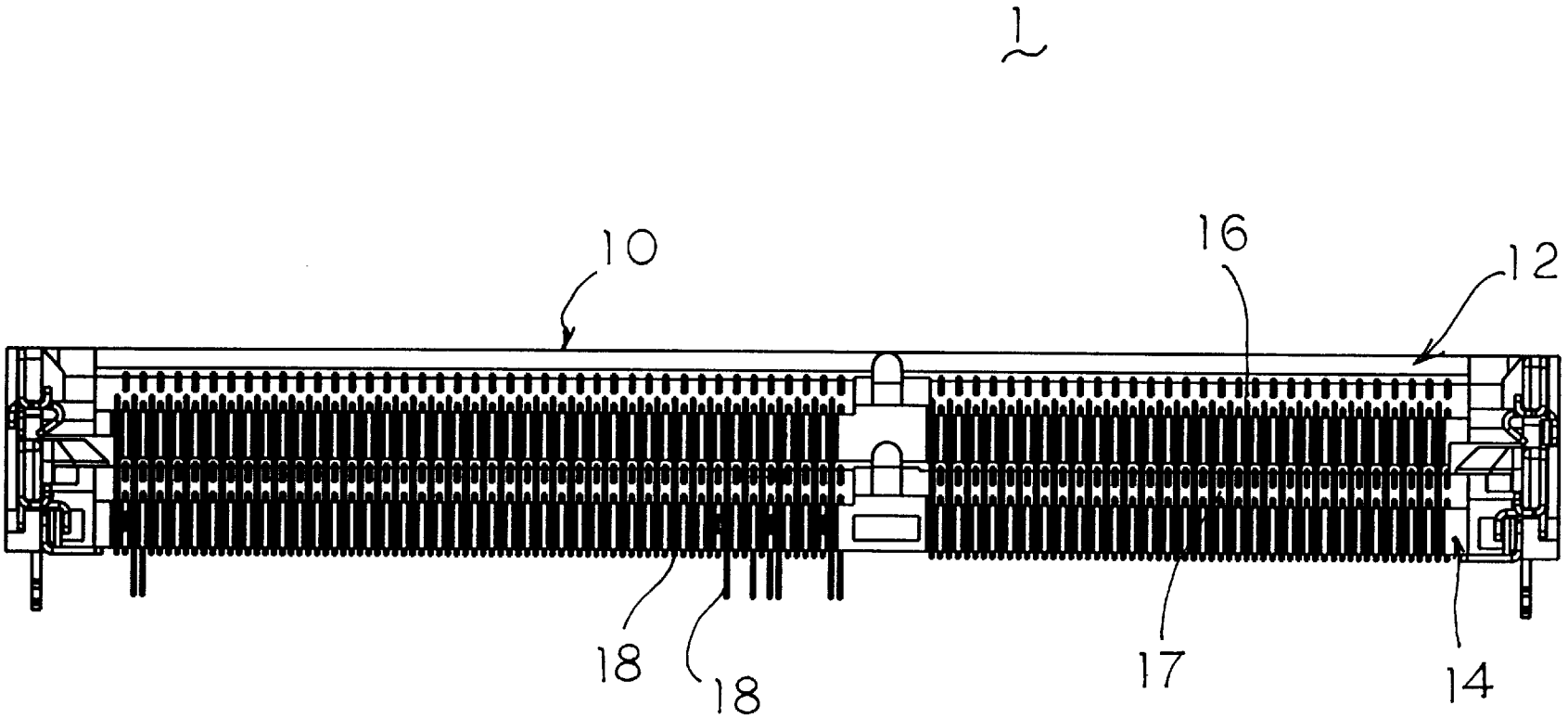
FIG. 7 is a full plan view of the connector assembly of FIG. 1.

As shown in FIG. 9, the lower module 200 is adapted to be first installed into the lower connection port 14, with the front edge of the lower module 200 being received within the lower central slot 17, at an insertion or full withdrawal angular position as shown in FIG. 4 where the first latching lug 28 is positioned under the lower module 200.

Successively, the lower module 200 is downwardly rotated about the lower central slot 17, and thus the pair of upper latch arms 20 will be deflected outwardly by slidable engagement between the first latching lugs 28 and the lateral sides of the lower module 200 until the lower module 200 completely passes over the first latching lugs 28. Naturally and preferably, the lower module 200 is continuously downwardly rotated to the completely locked horizontal position, by outwardly deflecting the lower latch arms 22, where the lower module 200 is retained in the lower connection port 14 by the lower latching lug 34 of the lower latch arm 22.

Understandably, the upper module 100 can be inserted into the upper connection port 12. FIG. 10 shows the whole assembly with both the upper module 100 and the lower module 200 therein.

Oppositely, during withdrawal of the upper and the lower modules 100 and 200, the upper module 100 is first backwardly, i.e., upwardly, rotated from the horizontal position to the insertion/withdrawal angular position by outward deflection of the upper latch arms 20, and leaves the upper connection port 12.

Successively, by manually outwardly deflecting the lower latch arms 22 and via the spring forces of the contacts 18 in the lower connection port 14 the lower module 200 is backwardly, i.e., upwardly, rotated from the horizontal position to the insertion/withdrawal angular position. Different from what is shown in the aforementioned copending application where by confrontation with the upper latch arm 20, the lower module will be temporarily held in an intermediate position between the upper latch arm and the lower latch arm, in this invention during the rotative upward movement, the lower module 200 will actively outwardly push the upper latch arm 20 away and pass over the upper latch arm 20 to reach the original insertion/withdrawal position without blocking, thus resulting in one step withdrawal thereof. This is because of formation of a guidance means around the lower portion of the upper latch arm 20. The details are as below.

Similar to the aforementioned copending application, referring to FIGS. 1–6 the lower support arm 26 which is similar to what is disclosed in the U.S. Pat. No. 5,997,332, includes a main body 80 retaining to the housing 10 with an upward first tang 82 adapted to cooperate with the main body 80 for interrelating the lower latch arm 22 so that the support arm 26 may supportably engage the lower latch arm 22 when the lower latch arm 22 is deflected. A downward second tang 84 is positioned beside the first tang 82, which is adapted to engage the fixed arm 23 under the lower latch arm 22 for preventing inward over-deflection of the lower latch arm 22. A downward third tang 86 is positioned beside the second tang 84, which is adapted to engage the fixed arm 23 for prevent outward over-deflection of the lower latch arm 22.

Somewhat similarly and somewhat differently, the upper support arm 24 includes a main body 60 retaining the upper support arm 24 to the housing 10 with an upward first tag 62 cooperating with the main body 60 to interrelate the upper latch arm 20 so that the upper support arm 24 may supportably engage the upper latch arm 20 when the upper latch arm 20 is deflected. A downward second tag 64 is positioned beside the first tag 62, which is adapted to engage a stopper tang 88 on the upper portion of the lower latch arm 22 for preventing outward over-deflection of the upper latch 20. A downward third tag 66 is positioned beside the second tag 64, which is adapted to engage the upper portion of the lower support arm 26 for preventing inward over-deflection of the upper latch arm 20.

Different from what is disclosed in the copending aforementioned application, the second tag 64 includes a slanting guidance surface 65 generally right under the upper latching lug 28. Thus, as soon as the lower module 200 is released from the lower latch arms 22, the edge portion of the rotatably upwardly moving lower module 200, wherein such upward rotation is due to resilient/restoring forces of the contacts 18 in the lower connection port 14, may guidably/automatically move along the guidance surface 85, thus capably outwardly deflecting the upper support arm 24 and its associated upper latch arm 20 until the lower module 200 finally fully reaches its original insertion/withdrawal position. Accordingly, a one step withdrawal of the lower module 200 is implemented in place of the two-step withdrawal disclosed in the aforementioned copending application.

It should be noted that in this embodiment the guidance surface is provided on the metal support arm, while such a guidance surface may be formed on the plastic latch arm instead. Also, in this embodiment the third tag 66 is adapted to engage the upper portion of the metal lower support arm 26, while alternately it can engage the upper portion of the lower latch arm 22 for obtaining the same effect.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claim. For example, the housing may be made by two separate pieces to respectively form the upper and lower connection ports as shown in the Pat. No. 5,755,585. Similarly, the latch arms may not be integrally formed with the housing but being instead the separate pieces, either metal or enhanced plastics, attached thereto. Moreover, in this embodiment the latch unit includes the latch arm and its associated support arm which are different materials, i.e., metal vs. plastics, while instead they may be integrally formed/manufactured together, either with different or same material thereof, for compliance with some application conditions.

Therefore, person of ordinary skill in this field are to understand that all such equivalent structures are to be included within the scope of the following claims.

We claim:

1. A double-deck connector assembly comprising:

an insulative housing defining upper and lower connection ports with contacts for respectively receiving therein upper and lower modules wherein both said upper module and said lower module are rotatively inserted thereinto;

a pair of upper latch arms extending from two opposite ends of the upper connection port;

a pair of lower latch arms extending from two opposite ends of the lower connection port;

a first latching lug formed on each of said pair of upper latch arms for retaining the upper module in position;

a second latching lug formed on each of said pair of lower latch arms for retaining the lower module in position; wherein a guidance surface is provided around a lower portion of each upper latch arm so that upon being released from the lower latch arm, the lower module can be rotatably upwardly moved along said guidance surface to outwardly deflect the corresponding latch arm away until reaching an initial insertion angular position which is essentially above the upper arm.

wherein the guidance surface is formed on an upper support arm positioned beside the corresponding upper latch arm;

wherein the upper and lower latch arms are integrally formed with the housing;

wherein the guidance surface is positioned right under the corresponding first latching lug.

* * * * *